US008602538B2

(12) United States Patent
Sekino et al.

(10) Patent No.: US 8,602,538 B2
(45) Date of Patent: Dec. 10, 2013

(54) INKJET PRINTING APPARATUS

(71) Applicant: Canon Kabushiki Kaisha, Tokyo (JP)

(72) Inventors: Takeshi Sekino, Yokohama (JP); Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/678,573

(22) Filed: Nov. 16, 2012

(65) Prior Publication Data

US 2013/0070032 A1 Mar. 21, 2013

Related U.S. Application Data

(62) Division of application No. 13/217,459, filed on Aug. 25, 2011, now Pat. No. 8,348,401.

(30) Foreign Application Priority Data

Aug. 30, 2010 (JP) ..... 2010-192346

(51) Int. Cl.
*B41J 2/175* (2006.01)

(52) U.S. Cl.
USPC ..... 347/85; 347/37; 347/40

(58) Field of Classification Search
USPC ..... 347/37, 40, 42, 65–67, 84–87, 22, 29
See application file for complete search history.

(56) References Cited

U.S. PATENT DOCUMENTS

| | | | | |
|---|---|---|---|---|
| 5,019,840 | A | 5/1991 | Watanabe et al. | |
| 5,971,525 | A | 10/1999 | Inoue et al. | |
| 6,540,342 | B2 | 4/2003 | Koshikawa et al. | |
| 7,066,572 | B2 * | 6/2006 | McGarry et al. | 347/40 |
| 7,566,108 | B2 | 7/2009 | Nojima et al. | |
| 2009/0179926 | A1 * | 7/2009 | Sugahara | 347/7 |
| 2009/0195625 | A1 | 8/2009 | Sekino et al. | |
| 2012/0050423 | A1 | 3/2012 | Ishikawa | |

FOREIGN PATENT DOCUMENTS

JP 2002-234179 A 8/2002

* cited by examiner

*Primary Examiner* — Thinh Nguyen
(74) *Attorney, Agent, or Firm* — Fitzpatrick, Cella, Harper & Scinto

(57) ABSTRACT

A turning operation of a headset lever is completed, and a printing head can be detached from a carriage part. By the above described turning operation of the head set lever, a supply port insertion and extraction part connected via a link slides, a needle pipe of the supply port insertion and extraction part is brought into a state of being the farthest from the printing head, and a needle insertion and extraction lever is brought into state in which it moves under a case wall. Thereby, an operator cannot turn only the needle insertion and extraction lever when the head set lever is in an opened state. In this manner, when the headset lever is in the opened state, the operation of the needle insertion and extraction lever which is used for connection of the supply port insertion and extraction part to ink supply port is restricted.

5 Claims, 11 Drawing Sheets

INKJET PRINTING APPARATUS

This application is a divisional of U.S. patent application Ser. No. 13/217,459, filed Aug. 25, 2011.

BACKGROUND OF THE INVENTION

1. Field of the Invention

The present invention relates to an inkjet printing apparatus, and more particularly relates to an inkjet printing apparatus in which attaching and removing of a printing head on a carriage that is movable with the printing head mounted thereon, and mutual attaching and removing between the printing head and an ink supply path are respectively performed by corresponding operating levers.

2. Description of the Related Art

In this type of attaching and removing mechanisms, for example, there is a mechanism in which, for mutual attaching and removing between a printing head and an ink supply path for supplying ink to the print head, needle pipes at the ink supply path side are inserted into seal connection members, which are formed of rubber or the like, at the printing head side. There are many cases where in order to insert such needle pipes into the seal connection members for connection, a relatively large force is required. Accordingly, in the above described attaching and removing configuration, the operation force for the attaching/removing operation is reduced by using the member which utilizes leverage of an operating lever or the like. Further, apart from this, an operating lever for the attaching/removing of the printing head on the carriage is frequently provided.

The operations of these levers are usually configured to be separately performed, and therefore, an operator performs the operations of a plurality of levers. Accordingly, there is the possibility that the operator performs a wrong operation such as performing the lever operations in a wrong order. If such a wrong operation is performed, there are some cases where proper connection of an ink supply system cannot be made to cause leakage of an ink so that the printing head does not eject the ink, or the joint structure of the ink supply system or the components of the printing head are damaged.

With respect to this problem, Japanese Patent Laid-Open No. 2002-234179 describes the configuration in which the wrong operation is inhibited in the halfway of the operation in the configuration provided with the two levers composed of the head set lever for attaching/removing of the printing head on the carriage, and the needle moving lever for attaching/removing of the printing head on the ink supply path. More specifically, if the needle moving lever is erroneously operated before the printing head is attached to the carriage by operation of the head set lever, the portion which is operated by the needle moving lever interferes with the head set lever to disable further operation of the needle moving lever. This configuration inhibits the error operation of the operating lever in the halfway, and also enables the operator to recognize the error operation of the lever.

However, in the configuration described in Japanese Patent Laid-Open No. 2002-234179, an operation can be performed from any lever of the two operating levers. Therefore, the operator is likely to operate the lever in the wrong order. In this case, the operation is inhibited by the other one of the two levers interfering with each other halfway in the operation, but, for example, when the operator performs an operation of the lever by applying an excessively large force, there are some cases where an unnatural force working on a basis of the portion of the above described mutual interference damages a part of the apparatus.

SUMMARY OF THE INVENTION

An object of the present invention is to provide an inkjet printing apparatus which always enables a plurality of operating parts, such as operating levers provided therein, to be operated in a correct order.

In a first aspect of the present invention, there is provided an ink jet printing apparatus that detachably mounts a printing head part provided with a printing head for ejecting ink and ejects ink from the printing head to perform printing, the apparatus comprising: a connection portion which is detachably mounted on the printing head part and configured to connect an ink supply path for supplying ink from an ink tank to the printing head part; a first operation member for effecting an operation of connecting and separating the connection portion to and from the printing head part; a second operation member for effecting an operation of attaching and removing the printing head part to and from the ink jet printing apparatus; a linkage mechanism configured to move the first operation member in a direction away from a mounting position of the printing head part, in association with a movement that causes the printing head part to be removable from the ink jet printing apparatus, the movement being caused by an operation of the second operation member in a state in which the connection portion has been separated from the printing head part by an operation of the first operation member; and a member for covering the first operation member at a position to which the first operation member is moved by the linkage mechanism.

According to the above configuration, when the plurality of operating parts such as the operating levers are provided in the apparatus, these operating parts are configured to be capable of being always operated in the correct order.

Further features of the present invention will become apparent from the following description of exemplary embodiments (with reference to the attached drawings).

DESCRIPTION OF THE EMBODIMENTS

Hereinafter, an embodiment of the present invention will be described in detail with reference to the drawings.

Figure 1:
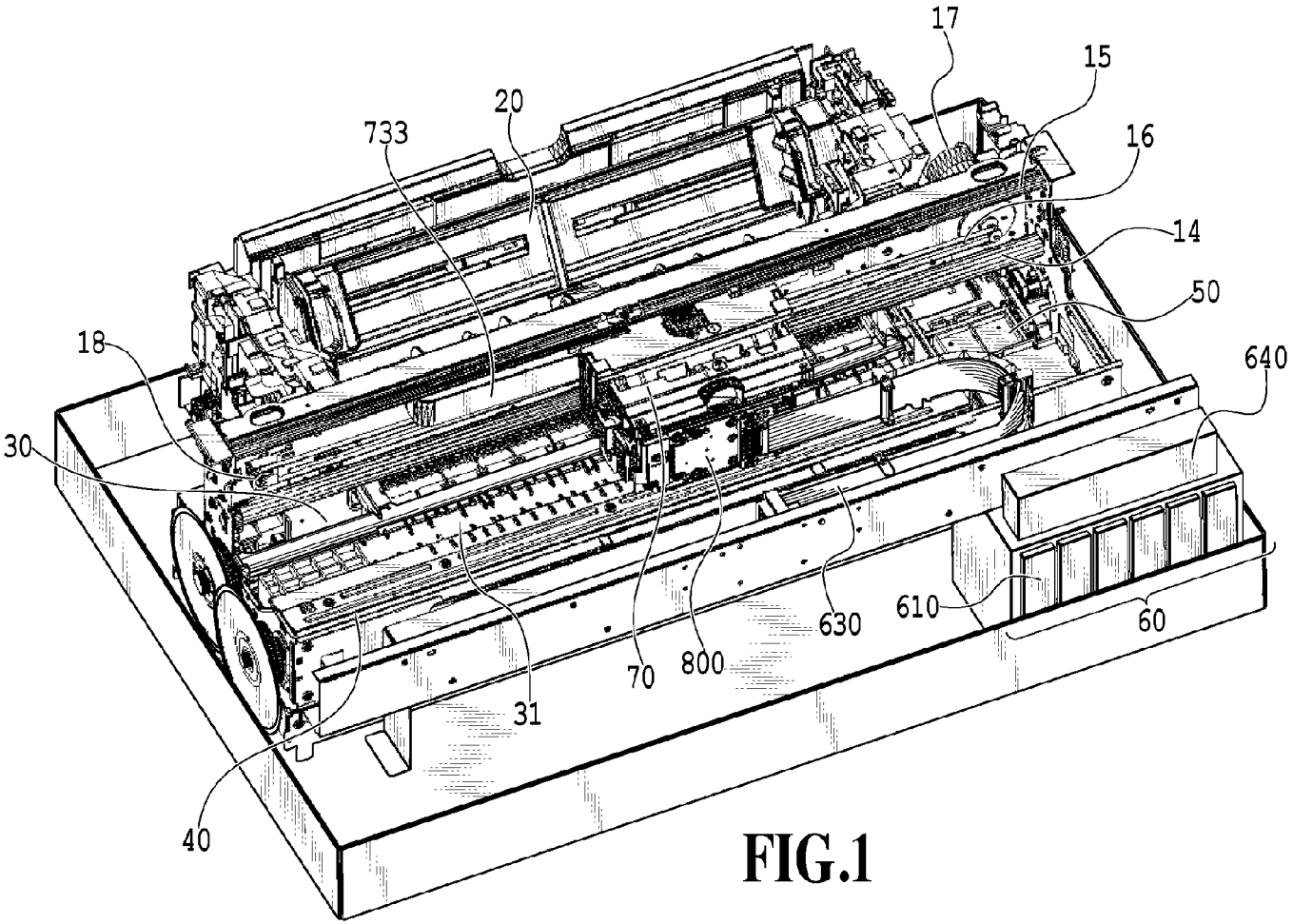
FIG. 1 is a perspective view showing an internal configuration of an inkjet printing apparatus according to an embodiment of the present invention.

FIG. 1 is a perspective view showing an inkjet printing apparatus according to an embodiment of the present invention. The printing apparatus of the present embodiment is constructed schematically by a sheet feeding section 20, a print medium conveying section (sheet conveying section) 30, a sheet discharge section 40, a carriage part 70 with a printing head part mounted thereon, a printing head restoring section (restoring unit) 50 and a supply tank unit 60.

Printing data which is sent from a host apparatus (not shown) is temporarily stored in a predetermined storage part of a storage device control unit configured on a control substrate (not illustrated), and the control unit starts a printing operation based on the stored printing data when a print start command is given. When the printing operation is started, a sheet feeding operation is performed first. The sheet feeding section 20 is constructed by an automatic sheet feeder (ASF), and print sheets as print media are fed one by one to the sheet conveying section 30 from the automatic sheet feeder for each printing operation. The fed print sheet is conveyed by a predetermined line feed amount by the sheet conveying section 30.

A route in which the carriage part 70 moves is provided above the sheet conveying section 30. The carriage part 70 is constructed by mainly including a printing head, and a carriage mounting the printing head thereon to scan (move) in a direction to intersect (normally orthogonal to) with a conveying direction of the print sheet. Movement of the carriage is guided and supported by a guide shaft 14 which is fixed to a chassis of the apparatus, and a support rail 15 which is fixed to an upper portion of the chassis. The carriage can reciprocate (scan) along the guide shaft 14 by transmission of a drive force of a carriage motor 17 to the carriage through a carriage belt 16 which is tightly wound between the carriage motor 17 and an idler pulley 18. Further, the carriage is provided with a supply port insertion and extraction part 800 as a channel connecting mechanism attached thereto, and ink supply tubes 630 constituted of flexible tubes are connected to the printing head through the supply port insertion and extraction part. The ink supply tubes 630 are laid around in such a manner as to be able to follow in an entire scanning range of the carriage for connection to the supply tank unit 60.

Main tanks 610 according to respective ink colors are detachably attached to the supply tank unit 60. Further, a supply pump unit 640 which is formed by a pump and the like for transferring the inks stored in the main tanks 610 to the printing head is provided. The supply tank unit 60 is placed in the vicinity of a sheet discharge port to be at the front surface of the apparatus. By the above configuration, during the scanning of the carriage part 70, the inks stored in the main tanks 610 can be supplied to the printing head through the ink supply tubes 630 by the supply pump unit 640.

A substrate on the carriage is electrically connected to a circuit board (control circuit) at the apparatus main body side through a flexible flat cable (FFC) 733. Thereby, a signal from a head control circuit is transmitted to the printing head through the FFC 733, and the inks can be ejected from the printing head in accordance with the printing data. Further, by reading a cord strip tightly laid in parallel with the scanning direction of the printing head by a CR encoder (not illustrated) mounted on the carriage, the ejection timing from the printing head in scanning can be determined. In this manner, when printing corresponding to one line is finished, the print sheet is fed by a predetermined amount by the sheet conveying section 30. After the printing is performed over the entire surface of the print sheet by repeatedly carrying out the operation, the print sheet is discharged by the sheet discharge section 40 to finish the printing.

Figure 2:
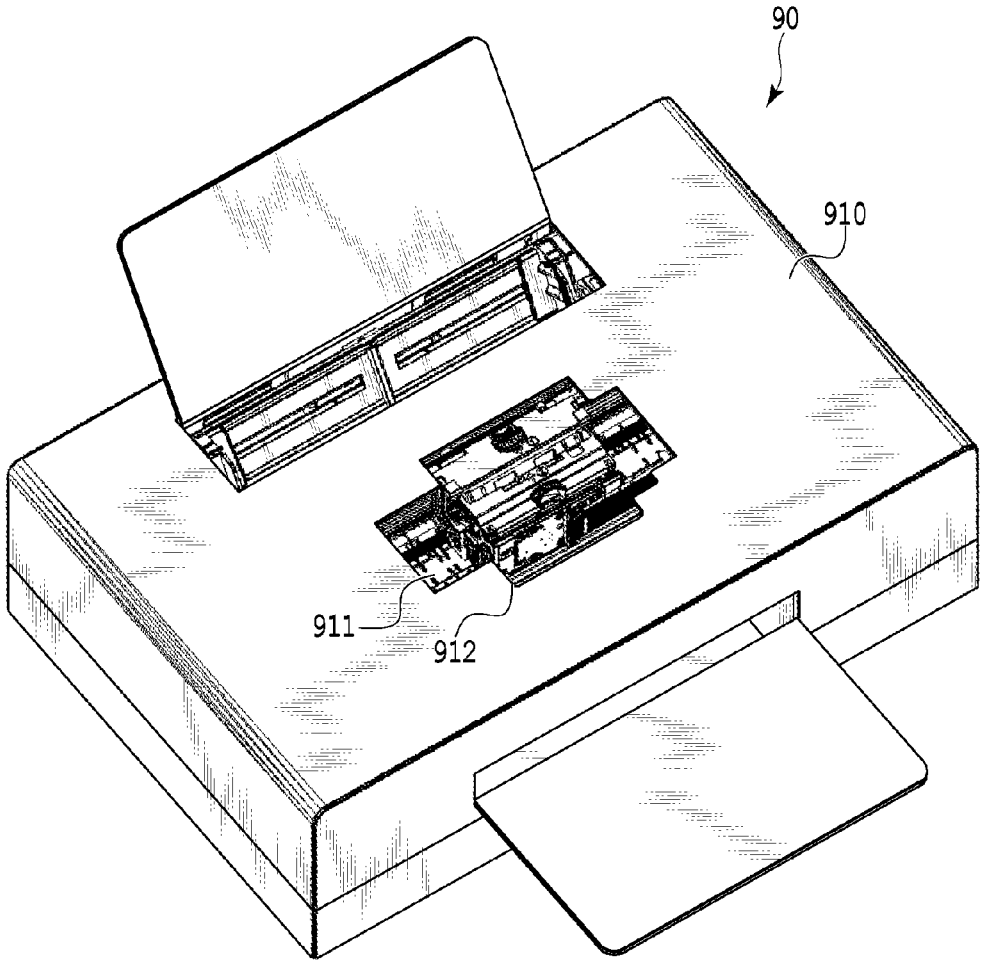
FIG. 2 is a perspective view showing a state in which the inkjet printing apparatus shown in FIG. 1 is covered with a main case constructing an outer jacket thereof.

FIG. 2 is a perspective view showing a state in which the inkjet printing apparatus shown in FIG. 1 except for the ASF 20 is covered with a main case 910 configuring an outer jacket. The main case 910 is formed of a resin, and may be constructed by a combination of a plurality of components, or may be constructed by one component. On a top surface of the main case 910, there are provided a power supply button (not illustrated) and a reset button (not illustrated) which is used mainly for performing reset when an abnormality occurs in the inkjet printing apparatus. An access cover (not illustrated) is provided on the front surface of the main case 910 to be openable and closable. By opening the access cover (not illustrated), a main part of the printing mechanism section in the main case 910 can be exposed, as shown in FIG. 2. The inkjet printing apparatus is provided with a cover opening and closing sensing device which senses opening of the access cover (not illustrated), and thereby, the opening of the access cover (not illustrated) is sensed. A cutout portion 912 is formed in an opening portion 911 of the main case 910, and by the cutout portion 912, a space for operating a needle insertion and extraction lever as will be described later is formed.

(Description of the Details of Respective Parts)

Next, the details of the carriage part, the printing head part and the like in the inkjet printing apparatus as described above will be described.

<Printing Head Part>

Figure 3:
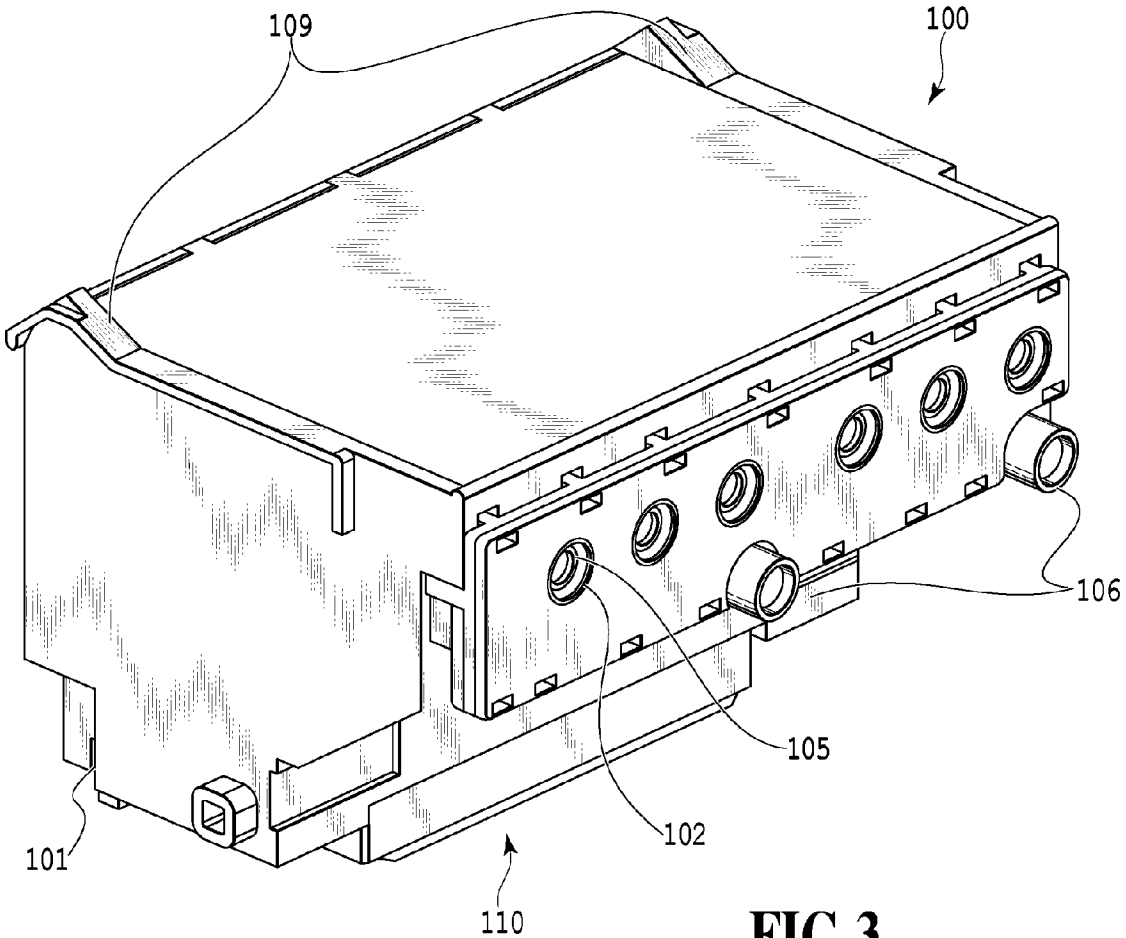
FIG. 3 is a perspective view showing a cartridge type printing head part which is detachably mounted on a carriage part shown in FIG. 1.

FIG. 3 is a perspective view showing a printing head part of a cartridge type which is detachably mounted on the carriage part 70. A printing head part 100 of the present embodiment includes ejection opening rows respectively for inks in six colors of cyan (C), magenta (M), yellow (Y), black (Bk), light cyan (LC) and light magenta (LM). A heater is provided in an inside of each of a plurality of ejection openings in each ejection opening row for generating thermal energy used as energy for ink ejection, and the ink is ejected from the ejection opening by applying electric pulses to the heater in response to printing signals.

Further, inside the printing head part 100, a sub tank (not shown) is provided for each ink color, and temporarily stores a corresponding ink which is sent to the printing head part 100 from the main ink tank 610. The supply tubes 630 (FIG. 1) for supplying inks to the sub tanks from the main ink tank are connected to the printing head part 100 at ink supply ports 102. More specifically, the supply port 102 has a cylindrical projected portion which is configured to be integrated with the printing head part 100. In each of the cylindrical projected portions, a hole larger than an outside diameter of a needle pipe is formed at each tip end portion so that the needle pipe which forms a supplied port of the supply port insertion and extraction part 800 (FIG. 1) can be inserted therein. Further, a cylindrical seal connection member 105 molded of a rubber, a soft resin or the like is fitted into an inside of the cylindrical projected portion. The seal connection member 105 is provided with a small hole formed at the center, the small hole having a diameter smaller than the outside diameter of the above described needle pipe, and a taper is provided in the small hole at the side where the needle pipe is inserted. By providing the seal connection member 105 in the ink supply port 102 in this manner, the needle pipe is inserted while expanding the small hole of the seal connection member 105, when the supply port insertion and extraction part 800 is connected to the ink supply port 102. Thereby, hermetical sealing by surface contact of an outer surface of the needle pipe and an inner surface of the small hole is ensured.

Inclined surfaces 109 which are formed with inclination angles and positioning engaging portions 101 are provided on top surfaces of both left and right side walls of a main body portion of the printing head part 100. Thereby, when the printing head part 100 is attached to the carriage, the printing head part 100 can be moved to a predetermined attaching position on the carriage in accordance with the turning of a head set lever which will be described later to be positioned therein.

<Carriage>

Figure 4:
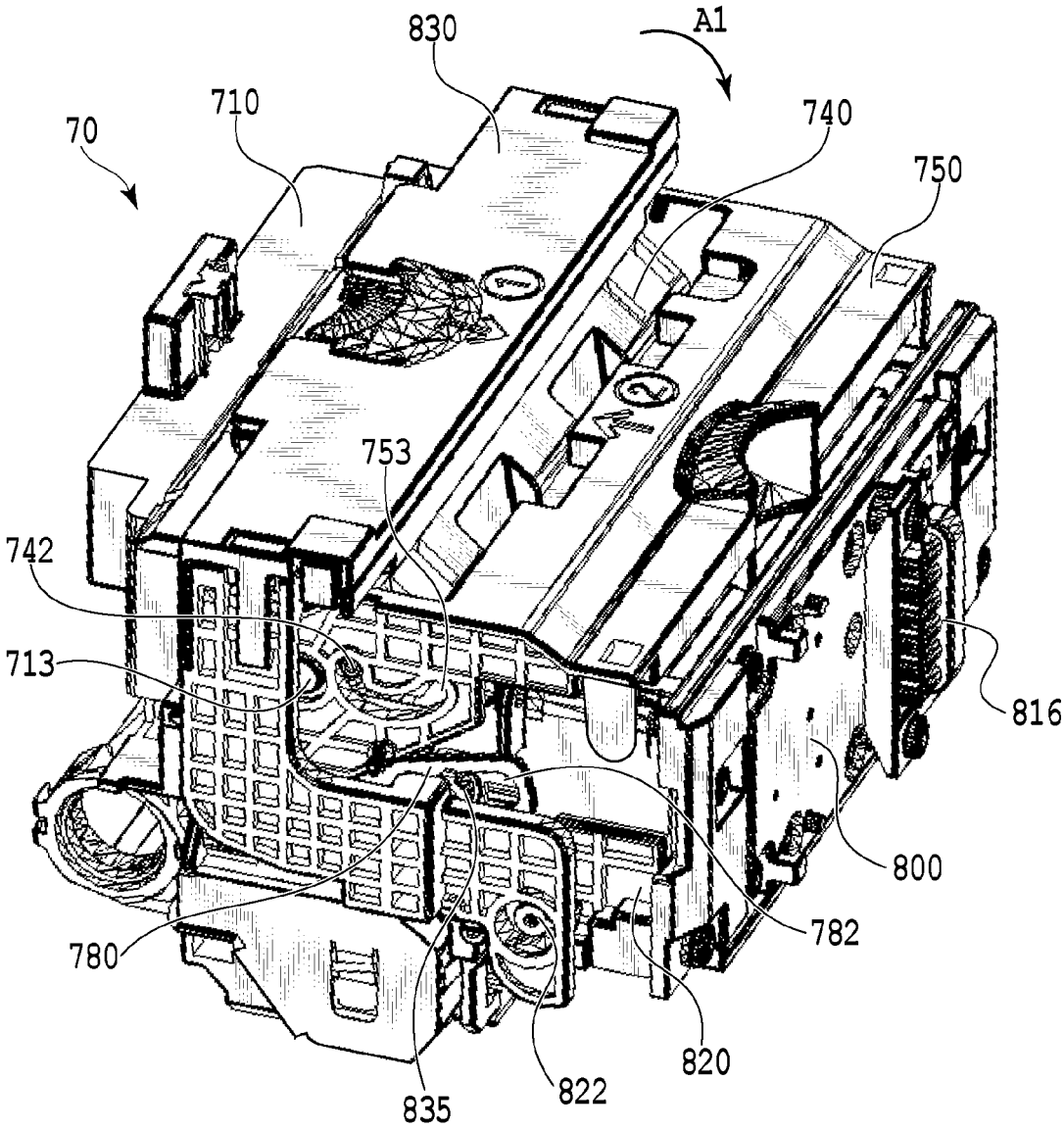
FIG. 4 is a perspective view showing a detailed configuration of the above described carriage part.
Figure 5:
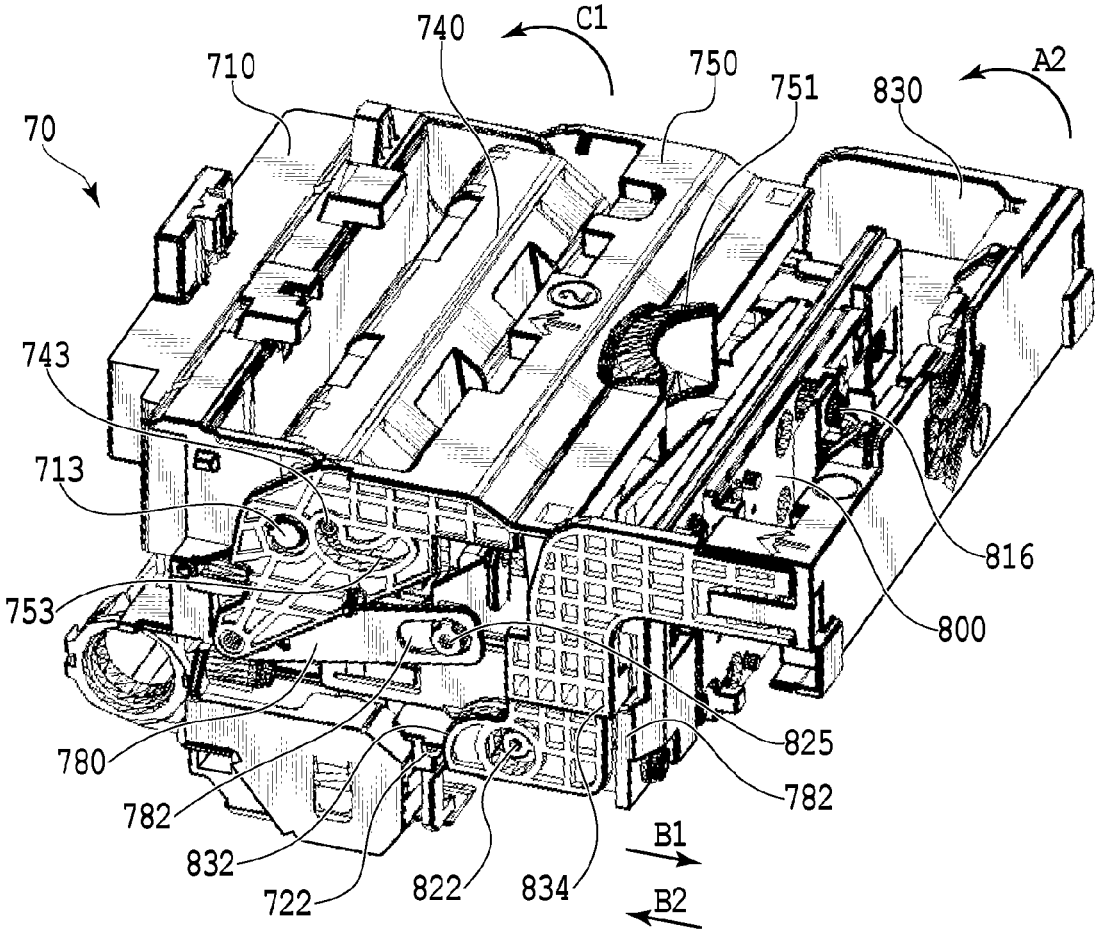
FIG. 5 is a perspective view showing the detailed configuration of the same above described carriage part.
Figure 6:
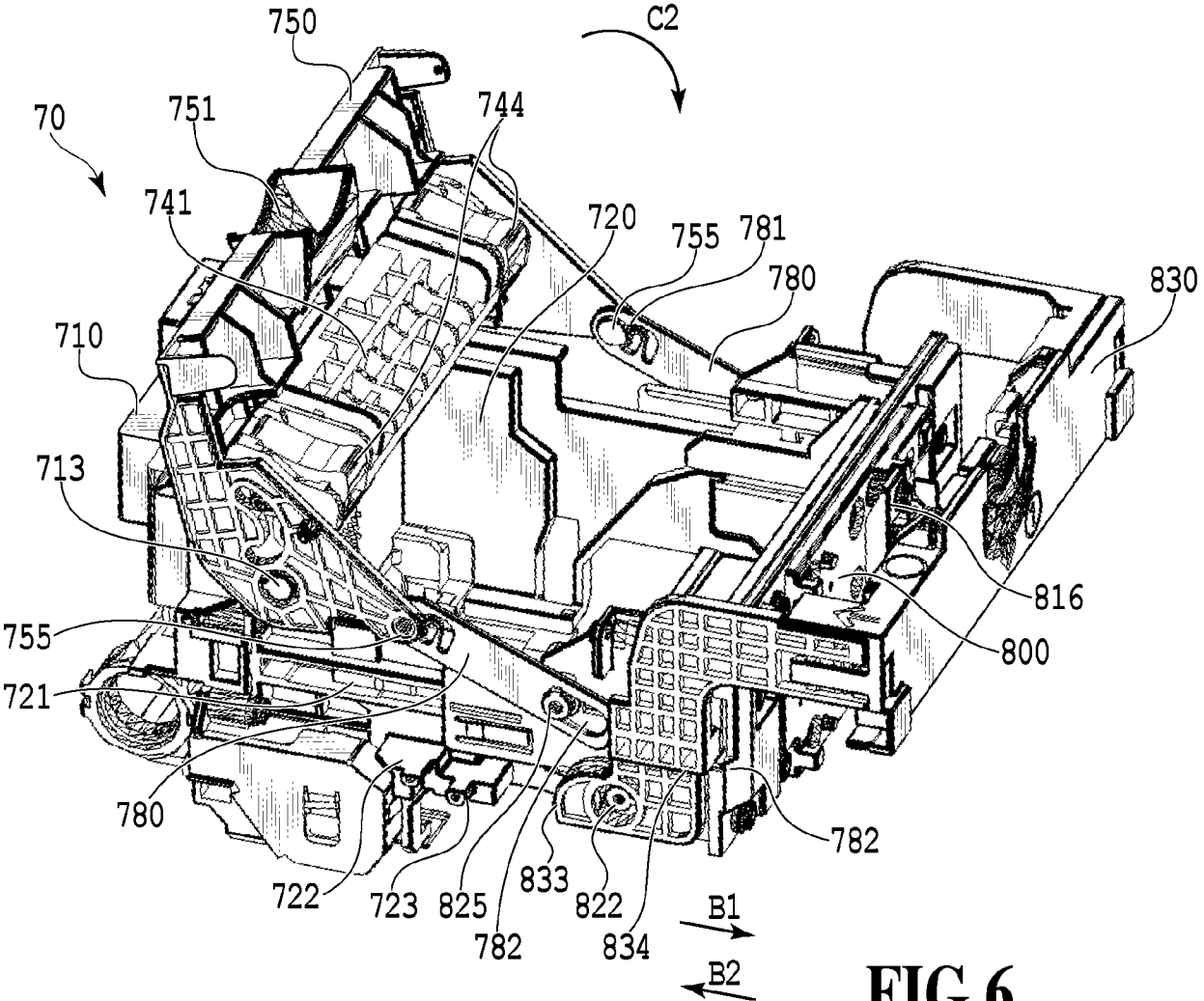
FIG. 6 is a perspective view showing the detailed configuration of the same above described carriage part.

FIGS. 4 to 6 are perspective views each showing a detailed configuration of the carriage part 70, and show three states in accordance with the operations of the head set lever (second operation member) and the needle insertion and extraction lever (first operation member), which will be described later.

Of these figures, FIG. 6 shows a state in which the printing head part 100 has been removed from a carriage 710 by the operation of a head set lever 750. The carriage part 70 is provided with a carriage cover 720 which guides the printing head part 100 to a printing head housing portion, and the head set lever 750 which integrally forms a head fixing portion 740 for fixing the printing head part to a predetermined position of the carriage. The printing head housing portion of the carriage 710 is provided with positioning projected portions 711 for positioning the printing head part 100 to an attaching position thereof. In correspondence with this, the positioning engaging portions 101 (FIG. 3) which engage with the positioning projected portions 711 are respectively formed in the printing head part 100. Further, in a head fixing portion 740, head fixing cams 744 which are urged by a spring (not shown) are provided at a part of a head fixing cam holder 741. The head fixing cam 744 makes contact with and engages with the inclined surface 109 formed at the printing head part 100 to apply a force in a direction to guide and fix the printing head part 100 to the predetermined attaching position. Further, the head fixing cam holder 741 is configured to be capable of swinging to the carriage 710 around rotating shafts 742 provided at both end portions thereof. Further, the head fixing cam holder 741 is provided with working bosses 743 which are engaged in guide grooves 753 of the head set lever 750 which will be described later and receive a force for turning the head fixing portion 740 by being associated with the opening/closing of the head set lever 750.

The head set lever 750 is configured to be capable of turning around a lever rotating shaft 713 provided at the carriage 710. The guide groove 753 of the head set lever 750 and the boss 743 of the aforementioned head fixing cam holder 741 are engaged with each other. Thereby, the head fixing cam holder 741 can turn in response to the opening/closing operation of the head set lever 750 to perform the opening/closing operation of the head fixing portion 740. By turning the head set lever 750 in the clockwise direction around the shaft 713, the printing head part 100 can be guided and moved to a predetermined attaching position on the carriage 710.

A lever side link connection portion 755 which is connected to the supply port insertion and extraction part 800 via a link member 780 is provided at one end of the head set lever 750. A connection round hole portion 781 which is engaged with a lever side link connection portion 755 is provided at one end side of the link member 780. Further, at the other end side of the ink member 780, which is separated from the connection round hole portion 781, a connection long hole portion 782 engaging with a link connection portion 825 which translates and moves the supply port insertion and extraction part 800 by being linked to a needle insertion and extraction lever 830 is provided. The connection long hole 782 is provided with a long hole formed therein, which acts as a dead zone in such a manner as not to swing the head set lever 750 via the link member 780 by translational movement of the supply port insertion and extraction 800 at the needle insertion and extraction operation which will be described later. By the above configuration, with the opening/closing of the head set lever 750, the link member 780 moves around the lever side link connection portion 755. At this time, the connection long hole portion 782 moves by the movement of the link member, a long hole end portion thereof makes contact with the supply side connection portion, and the supply port insertion and extraction portion 800 which is connected by a supply port side link connection portion 825 can move by being linked together thereto.

The lever side link connection portion 755 is configured to move the supply port insertion and extraction part to a large extent via the lever side link connection portion 755 and the link member, with the turning of the head set lever 750. An operating part 751 of the head set lever 750 is provided at a location at a larger distance from the rotating shaft 713 so as to reduce the operation force to be small. More specifically, the supply port insertion and extraction part 800 is configured to move significantly even if the head set lever is operated with a relatively small force.

Supply port slide portions 721 are provided at both sides of the carriage cover 720, which are configured of a pair of guide members mounting the supply port insertion and extraction part 800 thereon and slidably guide the supply port insertion and extraction part 800 in a lateral direction. Thereby, the supply port insertion and extraction part 800 is guided to translate and move by the pair of guide members provided at the carriage cover 720. As a result, the supply port insertion and extraction part 800 can perform the translational movement by being associated with the turning by the operation of the head set lever 750. Further, as described above, with the turning of the head set lever operating part, the supply port insertion and extraction part 800 also can move significantly. More specifically, the translational movement amount of the supply port insertion and extraction part 800 is configured to be large. In the present embodiment, by turning the head set lever by approximately 100 degrees, the supply port insertion and extraction part 800 can be moved by approximately 30 mm. The turning angle of the head set lever, and the moving amount of the supply port insertion and extraction part are not limited to these values as a matter of course.

In the vicinity of the supply port slide portion 721 of the carriage cover 720, a pushing-out guide portion 722 which is in slide contact with an outer peripheral cam of the needle insertion and extraction lever provided at the supply port insertion and extraction part 800, and a pull-in guide portion 723 which guides an inner peripheral cam surface of the needle insertion and extraction lever 830 are provided.

<Supply Port Insertion and Extraction Part>

Figure 10:
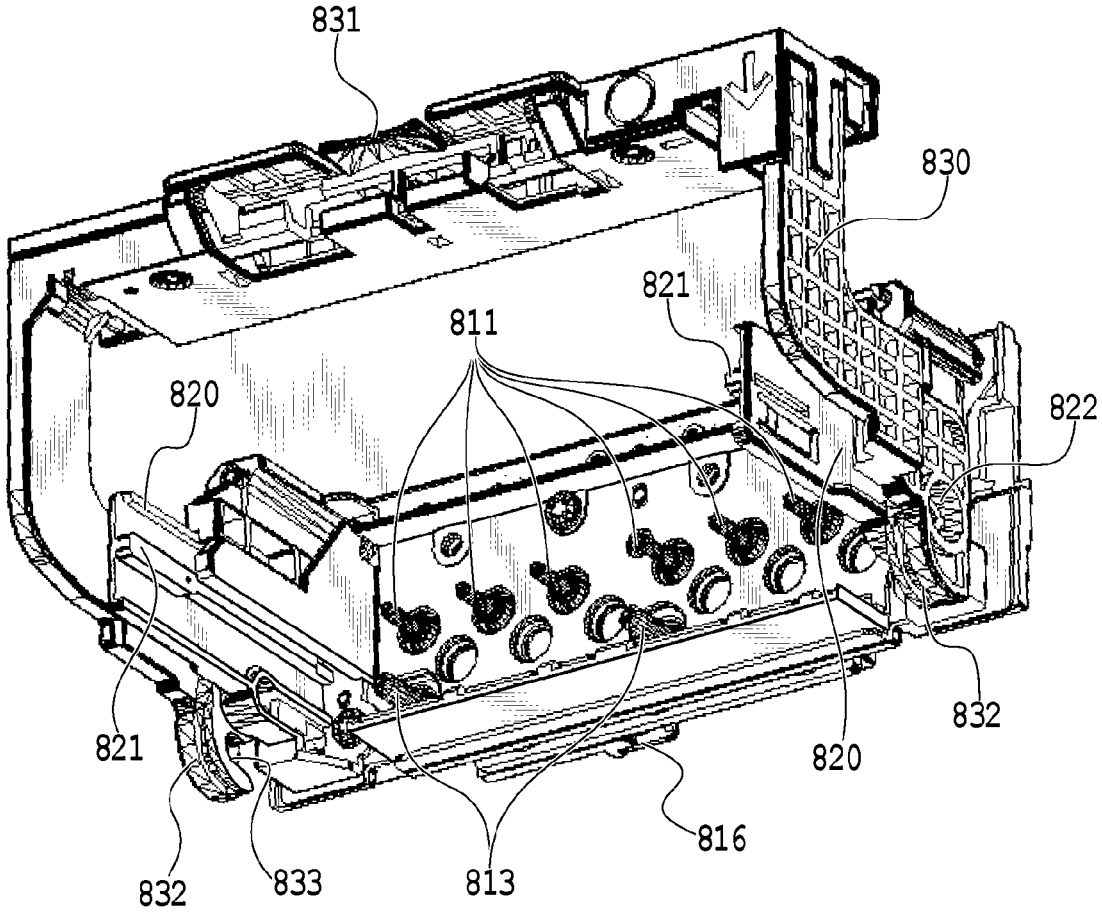
FIG. 10 is a perspective view showing a supply port insertion and extraction part according to the embodiment of the present invention.
Figure 11:
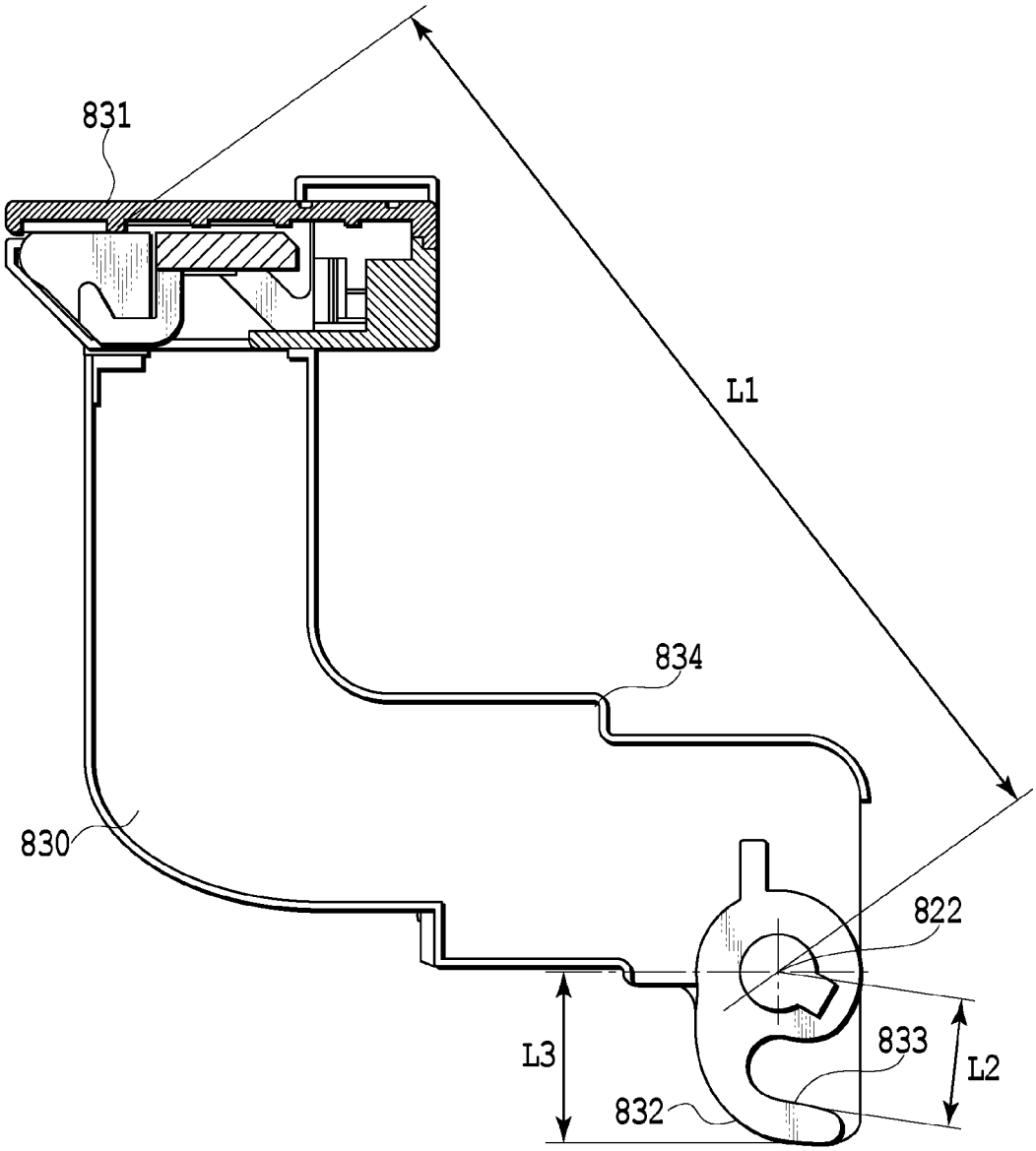
FIG. 11 is a sectional view schematically showing a needle insertion and extraction lever provided at the above described supply port insertion and extraction part.

The supply port insertion and extraction part 800 is provided in the carriage part 70, and performs the function of connecting and separating paths with a supply tube 822 to and from paths in the printing head part 100 by the insertion and extraction operation to and from the printing head part 100. FIG. 10 is a perspective view showing the supply port insertion and extraction part 800, and FIG. 11 is a sectional view schematically showing the needle insertion and extraction lever 830 provided at the supply port insertion and extraction part 800.

The supply port insertion and extraction part 800 includes needle pipes 811 as shown in FIG. 10, and the needle pips 811 can be inserted into the seal connection members 105 of the ink supply port 102 in the printing head part 100. The needle pipes 811 are each formed in a hollow tubular shape and are provided in correspondence with the seal connection members 105 of the printing head part 100. Further, a plurality of tube connection members 816 to which the ink supply tubes 630 connected to the main tanks according to respective ink colors are connected are disposed on the other surface of the supply port insertion and extraction part 800. The connection members 816 and the needle pies 811 communicate with one another through ink supply paths (not shown) provided inside the main body of the supply port insertion and extraction part.

Further, the supply port insertion and extraction part 800 is provided with a plurality of guiding bosses 821 corresponding to a plurality (two) of guiding boss holes 106 (FIG. 3) at the ink supply port side of the printing head part 100. Thereby, when the needle pipes 811 are inserted in the seal connection members 105 of the ink supply ports 102, movement of the supply port insertion and extraction part 800 is guided along the guiding boss holes 106. Slide members 820 which engage with guide bodies are provided on the left and right sides of the supply port insertion and extraction part 800 so as to be movable in a lateral direction along a pair of guide bodies provided at the supplied port slide guide portions 721 of the carriage cover 720. Each of the slide members 820 is provided with a slide portion 821 which projects inward.

The slide member 820 pivotally supports the needle insertion and extraction lever 830 including an operating part for an operator to operate for an insertion/extraction operation of the supply port insertion and extraction part so that the needle insertion and extraction lever 830 can turn around a lever rotating shaft 822. At the needle insertion and extraction lever 830, a supply port side link connection portion 825 at which the connection long hole portion 782 provided in the aforementioned link member 780 is turnably attached is provided.

By operating the needle insertion and extraction lever 830 to turn, the needle pipe 811 of the supply port insertion and extraction part 800 is inserted or extracted to and from the ink supply port 102 of the printing head part 100, and communication or separation of the ink supply path with or from the main ink tank can be performed. In order to establish connection between the ink supply port 102 of the printing head part 100 and the supply port insertion and extraction part 800, the needle pipe 811 is inserted in the seal connection member 105 molded of a rubber or the like, whereby a sealing performance of the channel is ensured. Accordingly, a large force is often required when the needle pipe 811 is inserted into the seal connection member 105. Therefore, as shown in FIG. 11, a distance L1 between the operating part 831 and the rotating shaft 822 of the needle insertion and extraction lever 830 is set so that respective ratios of the distance L1 to a distance L2 of the rotating shaft 822 and an inner peripheral cam surface acting on the guide shaft 723 of the carriage cover, and of the distance L1 to a distance L3 of the rotating shaft 822 and an outer peripheral cam surface acting on the guide shaft 722, become large. Thereby, the supply port insertion and extraction part 800 moves by an amount enough for the needle pipe 811 to be detached from the seal connection member 105. As a result, the operator can insert and extract the needle pipe 811 into or from the seal connection member 105 by only applying a relatively small operation force. In the present embodiment, the ratio of the distance L1 to the distance L2 or L3 is set to be about 7 to 10:1, and a slide amount of the supply port insertion and extraction part 800 is designed to be about 7 mm by turning the needle insertion and extraction lever 830 by about 90 degrees. In this manner, the slide amount of the supply port insertion and extraction part 800 by the operation of the needle insertion and extraction lever 830 is designed to be smaller than the slide amount accompanying the opening and closing operation of the aforementioned head seat lever 750.

(Procedure at the Time of Operation)

Next, an operation at the time of removing the printing head part 100 from the carriage 710 will be described mainly with reference to FIGS. 7 to 9. The operation is similarly performed as an operation before attaching the printing head part 100 even when the printing head is not attached.

First, an operator shifts the inkjet printing apparatus to an inkjet cartridge replacement mode by performing a predetermined operation. In the present embodiment, the control unit of the inkjet printing apparatus can shift to the inkjet cartridge replacement mode by that an operator continues to press a reset button (not shown) for a fixed time (for example, three seconds) or more. A button for shifting the apparatus to the inkjet cartridge replacement mode may be separately provided, wherein the inkjet printing apparatus may be shifted to the inkjet cartridge replacement mode by an operation of the button. When the inkjet printing apparatus is shifted to the inkjet cartridge replacement mode, the carriage part 70 is moved to an inkjet cartridge replacement position, which is a substantially intermediate portion in its moving range, as shown in FIG. 2.

Figure 7:
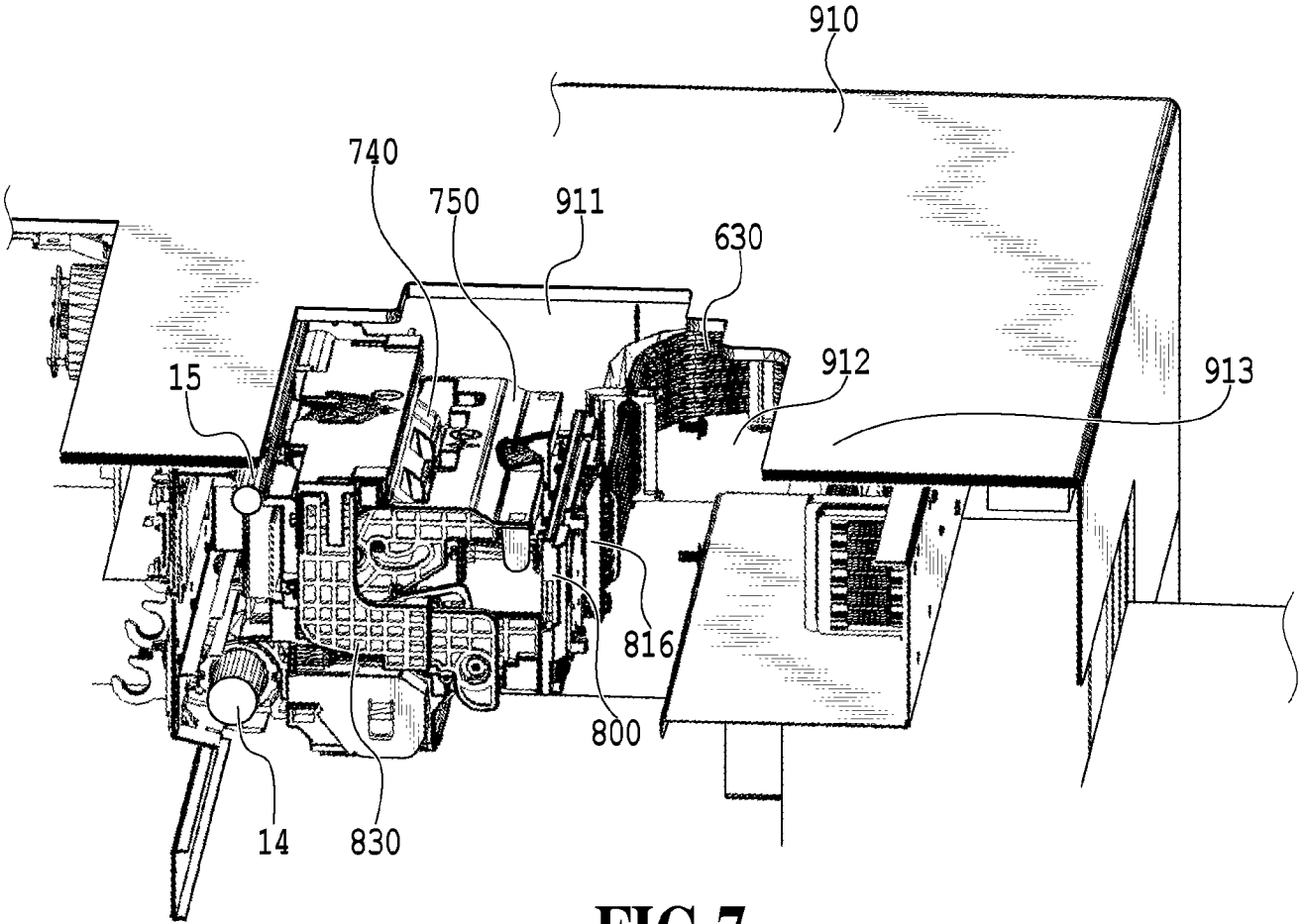
FIG. 7 is a perspective view showing a state in which a printing head part is attached and fixed to a carriage and a supply port insertion and extraction part is connected to the printing head, according to an embodiment of the present invention.

FIG. 7 is a perspective view showing a state in which the printing head part 100 is attached and fixed to the carriage, and the supply port insertion and extraction part 800 is connected. FIG. 8 is a perspective view showing a state in which the printing head part 100 is attached, but the supply port insertion and extraction part 800 is separated. Further, FIG. 9 is a perspective view showing a state in which the printing head part 100 is removed, and the supply port insertion and extraction part 800 is separated from the printing head part 100.

(Procedure of Opening Operation)

<Operation of Needle Insertion and Extraction Lever>

Figure 8:
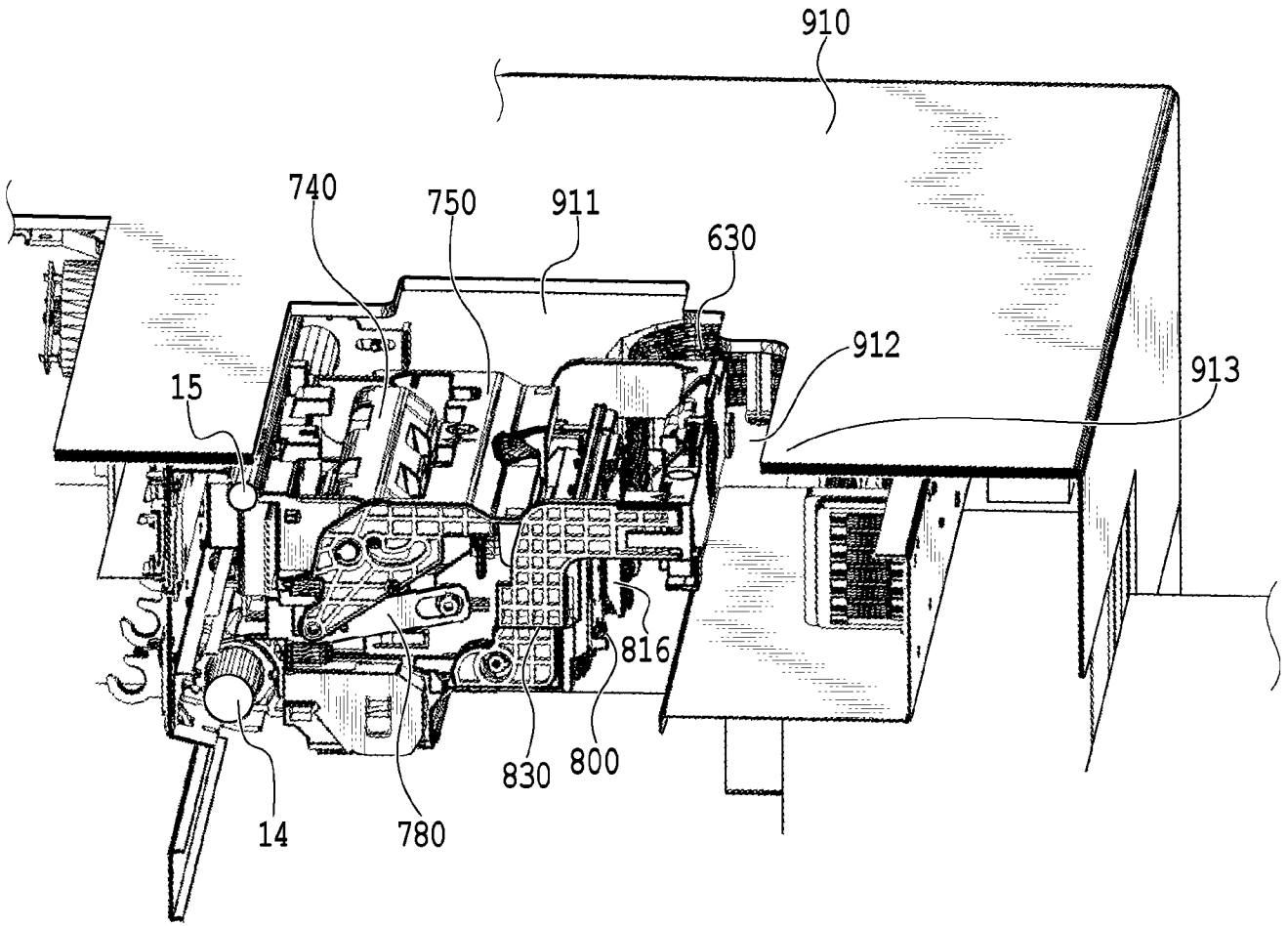
FIG. 8 is a perspective view likewise showing a state in which the printing head part is attached to the carriage, but the supply port insertion and extraction part is separated from the printing head.
Figure 9:
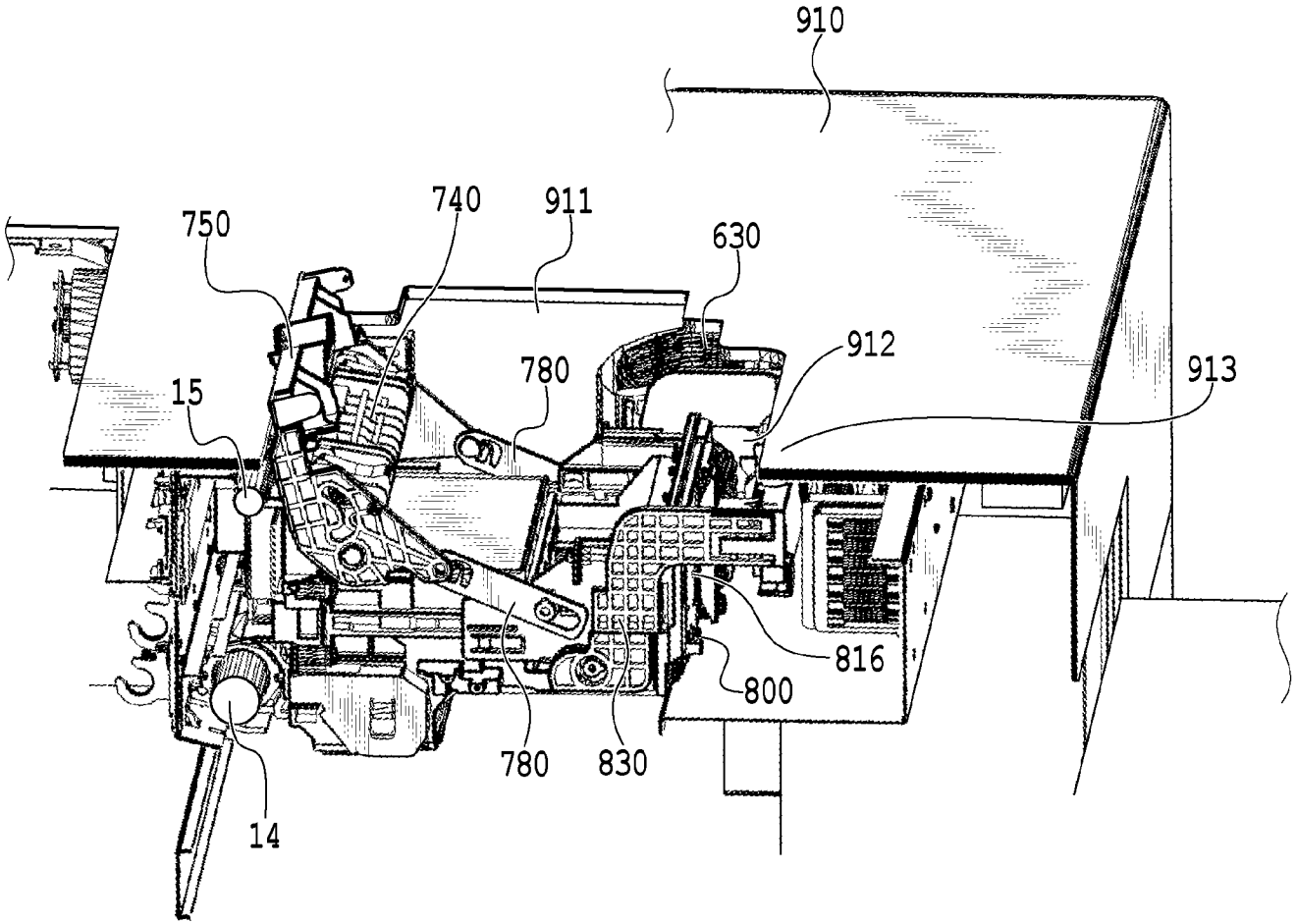
FIG. 9 is a perspective view likewise showing a state in which the printing head part is detached from the carriage, and the supply port insertion and extraction portion is separated from the printing head part.

As shown in FIGS. 7 to 9, in the printing head attaching/removing position, the cutout portion 912 is formed in the opening portion 911 of the main case 91, and the cutout portion 912 makes a space in which the needle insertion and extraction lever 830 can be operated be formed.

As shown in FIGS. 4 and 7, at this position, the operator can operate and turn the needle insertion and extraction lever 830 which is a first lever, in the direction of an arrow A1 shown in FIG. 4 with the rotating shaft 822 as a support point, from a state in which the printing head part 100 is attached. Here, when the needle insertion and extraction lever 830 is operated to be turned, the outer peripheral cam surface 832 of the needle insertion and extraction lever 830 is pushed while being in slide and friction contact with the pushing-out guide shaft 722 on the carriage cover 720 to translate and move the supply port insertion and extraction part 800 in the direction of an arrow B1 shown in FIG. 5 (first movement). At this time, the needle pipes are disconnected from the seal connection portions provided at the ink supply ports of the printing head by being moved and extracted, whereby connection of the ink supply paths is cut off (FIGS. 5 and 8).

As described above, the slide moving amount of the supply port insertion and extraction part 800 at this time is configured to be equal to an amount by which the needle pipes 811 are separated from the seal connection portions 105. Further, while the supply port insertion and extraction part 800 slides and moves, the link connection portion 825 at the supply port insertion and extraction part side on the slide portion 820 is configured to be movable in the connection long hole portion 782 provided in the link 780. Thereby, even if an operation of the needle insertion and extraction lever 830 is performed, the link connection portion 825 moves in the connection long hole portion 780 acting as a dead zone portion of the link member 780, and therefore, a force for swinging the head set lever 750 does not occur. Further, as shown in FIG. 6, in the state in which the turning of the needle insertion and extraction lever 830 is finished, a needle insertion and extraction lever opening restriction portion of the needle insertion and extraction lever 830 makes contact with a rotational detent provided at the supply port insertion and extraction part 800 and stops. In the aforementioned state in which the needle insertion and extraction lever 830 is opened, the posture is configured to be kept by the rotational moment by the self weight of the needle insertion and extraction lever 830 even if the operator takes his or her hand off the needle insertion and extraction lever 830.

<Operation of Head Set Lever>

An operator can turn the head set lever 750 which is a second lever in the direction of an arrow C1 shown in FIG. 5 with the rotating shaft 713 as a support point from the state shown in FIGS. 5 and 8. Thereby, an operation force is transmitted to the head fixing cam holder boss 743 which is engaged in the guide groove 753 of the head set lever 750, and when the operation force exceeds the pressing force of the head fixing spring via the head fixing cam 744, the fixation of the printing head by the head fixing portion 740 can be released. With the turning of the head set lever 750 during this time, the link 780 moves around the lever side link connection portion 755. At this time, the link member 780 translates and moves the supply port insertion and extraction part 800 connected by the supply port side link connection portion 825 further away in the direction of the arrow B1 (second movement). More specifically, the supply port insertion and extraction part 800 is guided by the guide portion 721 provided at the carriage cover 710, and moves in the direction of being away from the printing head part 100 against a restoring force F of the supply tube.

When the turning operation of the head set lever 750 is completed, the head fixing portion 740 which is linked to this operation is opened by turning around the head fixing cam holder shaft 742 to be in the state shown in FIGS. 6 and 9 in which the head set lever 750 is completely in an opened state. At this time, the slide movement in the direction of the arrow B1 of the supply port insertion and extraction part 800 connected via the link 780 is finished. At this time, the needle pipes 811 of the supply port insertion and extraction part 800 are in the state of being the farthest from the printing head.

Here, as shown in FIG. 9, a case wall 913 is provided integrally with the main case in the above described slide direction of the opening portion 911 of the main case 910. Thereby, in a state in which the supply port insertion and extraction part 800 is slid and moved in the direction of the arrow B1 (FIG. 5) by the turning operation of the aforementioned head set lever 750, the operating part 831 of the needle insertion and extraction lever 830 is in a state in which the operating part 831 is moved under the case wall 913. More specifically, the position of the case wall 913 is a position in which the operator cannot operate the needle insertion and extraction lever 830, or a position in which the operator cannot turn the needle insertion and extraction lever 830 since the needle insertion and extraction lever 830 interferes with the case wall 913 even if the operator tries to turn the needle insertion and extraction lever 830. Accordingly, the operator cannot turn only the needle insertion and extraction lever 830 when the head set lever 750 is in the opened state. In this manner, there is provided the structure which restricts the operation of the needle insertion and extraction lever 830 which is used for connection of the supply port insertion and extraction part 800 to the ink supply port 102 when the head set lever 750 is in the opened state. As a result, the operator is prevented from mistakenly operating the needle insertion and extraction lever 830 before operating the head set lever 750. In this state, the operator can remove the printing head part 100 from the printing apparatus by pulling out the printing head part 100 diagonally upward from the carriage part 70.

In the state of FIGS. 6 and 9, the lever side link connection portion 755 of the head set lever 750 is configured to be located at a position above a line connecting the rotating shaft 713 of the cover and the supply port side link connection portion 825. In any of an opened and a closed states of the head set lever 750, the supply port insertion and extraction part 800 is urged in the direction (the arrow B2) of being closer to the printing head by the restoring force F of the tube. Accordingly, in a state of exceeding the support point as shown in FIG. 6, the restoring force F of the tube is configured to form a toggle mechanism which urges the lever side link connection portion 755 of the head set lever 750 in the direction of the arrow C1 via the link mechanism to press and urge the head set lever 750 to the opened state side. From the above configuration, when the head set lever 750 is brought into the opened state, the head set lever 750 can be urged to the opened state (FIGS. 6 and 9) to be stably held even if the carriage part 70 is not provided with a special urging member or the like.

(Procedure of Closing Operation)

Next, a case in which the operator attaches the printing head part 100 to the carriage 710 will be described.

First, in the state shown in FIGS. 6 and 9, the operator attaches the printing head part 100 to the carriage part 70. Subsequently, the operator operates and turns the head set lever 750 in the direction of an arrow C2 shown in FIG. 6. In associated with the turning of the head set lever 750, the head fixing part 740 performs the movement of fixing the printing head part by turning around the shaft 742 of the head fixing cam holder 741. Thereupon, the head fixing cam 744 provided at the head fixing part 740 makes contact with the printing head part 100, and a pressing force of the head fixing spring via the head fixing cam 744 presses the printing head part 100 to the carriage 710 to be positioned and fixed therein.

At the same time, the link member 780 moves in associated with the turning of the head set lever 750. More specifically, when the connection long hole portion 782 of the link member 780 moves to make contact with the supply port side link connection portion 825, the supply port insertion and extraction part 800 linearly moves in the direction of the arrow B2. In the movement, the supply port insertion and extraction part 800 is guided by the guide portion 721 provided at the carriage cover, and largely moves in the direction of being closer to the printing head part 100. Thereby, the needle pipe 811 moves to the vicinity of the seal connection portion 105 of the printing head part 100.

By the translational movement of the supply port insertion and extraction part 800 which is associated with the turning of the head set lever 750 as described above, the operating part 831 of the needle insertion and extraction lever 830 which is hidden by the case wall 913 of the main case 910 moves to a position under the cutout portion 912 of the opening section 911. Thereby, when the head set lever is brought into the closed state, the operator can operate the needle insertion and extraction lever 830 (FIGS. 5 and 8).

Subsequently, from the state shown in FIGS. 5 and 8 in which the printing head part 100 is attached and fixed, the needle insertion and extraction lever 830 is turned in the direction of the arrow A2 shown in FIG. 5. Thereby, the inner peripheral cam surface 833 of the needle insertion and extraction lever 830 is pulled in while acting on the pull-in guide shaft 723 on the carriage cover 720 to translate and move the supply port insertion and extraction part 800 in the direction of the arrow B2. The supply port side link connection portion 825 on the slide portion 820 is configured to move in the connection long hole portion 782 which is a dead zone provided in the link 780 while the supply port insertion and extraction part 800 slides and moves. Accordingly, the operation of the needle insertion and extraction lever 830 does not cause the turning of the head set lever 750 via the link 780.

When the supply port insertion and extraction part 800 advances in the direction of the printing head part 100 by the operation of the needle insertion and extraction lever 830, the positioning guide boss 821 provided at the supply port insertion and extraction part 800 is inserted into the guide boss hole 106 of the printing head part 100 and is directly guided. Further, by the translational movement associated with the operation of the needle insertion and extraction lever 830, the needle pipes 811 are inserted into the ink supply ports 102 which are formed in the printing head part 100. More specifically, the needle pipe 811 is inserted while expanding the small hole of the seal connection member 105, and hermetical sealing as the ink supply path is ensured by surface contact between the outer surface of the needle pipe 811 and the inner surface of the small hole. In this manner, the needle pipes 811 are inserted after the supply port insertion and extraction part 800 is directly positioned to the printing head part 100, making it possible to establish stable and reliable communication of the channels.

In a state in which the turning of the needle insertion and extraction lever 830 is finished as shown in FIG. 4, the needle insertion and extraction lever 830 is engaged with the projected portion provided at the carriage 710. Thereby, even in the scanning of the carriage part 70, the posture of the needle insertion and extraction lever 830 is held. As described above, the operator sequentially performs the turning operations of the needle insertion and extraction lever 830 and the head set lever 750, thereby making it possible to complete the positioning and fixing of the printing head and the connecting operation of the connection portions (FIGS. 4 and 7).

As described above, according to the present embodiment, the operator can operate the two operating levers in the correct order without paying attention particularly.

In the aforementioned embodiment, the case of supplying the ink to the printing head through the supply tube is described as an example, but the present invention can be applied also to a method in which the tank is directly attached to the printing head. More specifically, the present invention can be similarly applied to a case in which there are provided a plurality of levers, for example, composed of a lever for carrying out fixation of the printing head to the carriage part and a lever for carrying out the operation of inserting the supplied port provided in the tank on the carriage part into the ink supply port of the printing head.

Further, in the aforementioned embodiment, the case of attaching one printing head to the carriage part is described as an example, but the present invention can be freely carried out irrespective of the number of printing heads. For example, besides the inkjet printing apparatus using one or more printing heads, the present invention can be used in the inkjet printing apparatus for color printing in use of a plurality of printing heads using inks in different colors. Alternatively, the present invention can be similarly applied to a tone printing inkjet printing apparatus using a plurality of printing heads using inks in the same color with different densities, and further to a case of an inkjet printing apparatus in combination of them.

Furthermore, the present invention can be applied also to an inkjet printing apparatus using an inkjet head cartridge (printing head) using, for example, an electromechanical transducer such as a piezoelectric element, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-192346, filed Aug. 30, 2010, which is hereby incorporated by reference herein in its entirety.

What is claimed is:

1. An ink jet printing apparatus comprising:

a printing head configured to discharge ink;

a carriage configured to mount the printing head;

an ink passage member configured to supply ink to the printing head;

a connecting member, mounted on the carriage, configured to be moveable to a connecting position where the ink passage member is connected to the printing head and to a first disconnecting position where the ink passage member is not connected to the printing head;

a first operating member configured to move the connecting member to the connecting position and to the first disconnecting position;

a second operating member configured to be movable to a first position where the printing head is fixed to the carriage and a second position where the printing head is able to be attached to and detached from the carriage; and a linking member configured to link the second operating member to the connecting member, the linking member moving the connecting member from the first disconnecting position to a second disconnecting position, which is further from the connecting position than from the first disconnecting position, when the second operating member moves from the first position to the second position.

2. The ink jet printing apparatus according to claim 1, further comprising a cover configured to cover the connecting member when the connecting member moves to the second disconnecting position.

3. The ink jet printing apparatus according to claim 1, wherein a distance in which the connecting member moves from the first disconnecting position to the second disconnecting position is greater than a distance in which the connecting member moves from the connecting position to the first disconnecting position.

4. The ink jet printing apparatus according to claim 1, wherein the first operating member and the second operating member move rotationally, and wherein the connecting member slidely moves between the connecting position and the second disconnecting position.

5. The ink jet printing apparatus according to claim 1, further comprising an ink tank configured to store ink to be supplied to the printing head, wherein the ink passage member comprises a tube configured to supply ink from the ink tank to the printing head.

* * * * *